US005195714A

United States Patent [19]

Stewart

[11] Patent Number: 5,195,714

[45] Date of Patent: Mar. 23, 1993

[54] BOOKHOLDER WITH ADJUSTABLE SHADE

[76] Inventor: Richard M. Stewart, 238 Central Rd., Middlebury, Conn. 06762

[21] Appl. No.: 851,276

[22] Filed: Mar. 13, 1992

Related U.S. Application Data

[63] Continuation-in-part of Ser. No. 760,117, Sep. 16, 1991, abandoned.

[51] Int. Cl.[5] ..... A47B 97/04

[52] U.S. Cl. ..... 248/448; 248/451; 248/457

[58] Field of Search ..... 248/448, 451, 457, 441.1, 248/444.1, 446; 362/98, 358, 354; 160/134, 127

[56] References Cited

U.S. PATENT DOCUMENTS

| | | | |
|---|---|---|---|
| 438,856 | 10/1890 | Muller | 248/447.2 X |
| 1,347,645 | 7/1920 | Manny | 248/448 |
| 1,396,700 | 11/1921 | Greenwood | 248/451 |
| 1,494,212 | 5/1924 | Bromley | 248/447.2 X |
| 1,538,198 | 5/1925 | Manchester . | |
| 1,712,814 | 5/1929 | Dierks | 248/457 |
| 1,781,203 | 11/1930 | Teleki | 248/159 X |
| 2,590,657 | 3/1952 | Shepard | 88/74 |
| 3,351,312 | 11/1967 | Ballas | 248/448 |
| 3,905,573 | 9/1975 | Davis | 248/447.2 X |
| 4,191,354 | 3/1980 | Chia-Liu | 248/451 X |
| 4,290,093 | 9/1981 | Thompson et al. | 362/98 |
| 4,700,634 | 10/1987 | Mills et al. | 108/43 |
| 4,896,252 | 1/1990 | Stewart | 362/98 |
| 4,907,773 | 3/1990 | Stewart | 248/453 |
| 4,998,703 | 3/1991 | Stewart | 248/447 |

*Primary Examiner*—David M. Purol
*Attorney, Agent, or Firm*—William C. Crutcher

[57] ABSTRACT

An improved bookholder for use with a pole lamp comprising a book support having a back rest and pivotable ledges adapted to hold the book in a selectable orientation, an attachment at one end thereof to the bookholder, the arm being sufficiently flexible to be bent to a desired shape and sufficiently rigid to maintain the shape after it is bent, and a shade attached to the other end of the adjustable arm, whereby the shade may be adjusted with respect to the light source and a book on the book support. Preferably, the shade comprises light-attenuating vanes which may be folded up like a fan when not in use, or opened to any desired extent to change the size of the shade. The adjustable arm holding the shade may be bent or moved in a variety of directions to adjust the position of the shade with respect to the light source.

12 Claims, 4 Drawing Sheets

BOOKHOLDER WITH ADJUSTABLE SHADE

This is a continuation-in-part application of application Ser. No. 07/760,117, filed Sept. 16, 1991 now abandoned which is currently pending before the Patent and Trademark Office.

BACKGROUND OF THE INVENTION

This invention relates generally to an improved bookholder for use with a source of illumination, such as a piano lamp, pole lamp or similar light source on a separate support or stand.

More particularly, the invention relates to improvements in a bookholder adapted for attachment to a separate light source standard with improved means for shading the eyes of the reader from the light source while reading in a reclined or sitting position.

In my U.S. Pat. No. 4,907,777 issued Mar. 13, 1990, an improved bookholder was disclosed for inclined reading in bed, wherein a support arm assembly was pivotally attached to an inclined back wall. The back wall was supported from a base to form the lid for an open box structure with an illuminating device. The bookholder was intended for use in a bedside table.

Further improvements to this type of bookholder led to my U.S. Pat. No. 4,896,252 issued Jan. 23, 1990, wherein a pair of separately movable arms were pivotally attached to a back rest as to provide ledges for supporting a book for reclined reading, or alternatively supporting a book in horizontal position in the manner of a lectern.

Further improvements led to my U.S. Pat. No. 4,998,703, issued Mar. 12, 1991 in which the pivotal ledges for holding a book in a number of different orientations, also were pivotable to provide the side walls of a box-like structure, which also contained an illuminating light source. The fixed front wall of the box-like structure serve to shade the reader's eyes from the light source.

While the aforesaid bookholders are useful in providing compact bookholders with a self contained light source which can be closed up when not in use, there are situations were space is limited, while at the same time existing independent light sources are available. Examples of such light sources include pole lamps, or piano lamps, with a light source mounted on a standard such as a base and a support pole. Such lamps come in a variety of shapes and sizes and may also include tall table lamps or lamps adapted for clamping to beds or tables. Such lamps usually have decorative shades for directing the light in a downwardly direction, but are poorly suited for looking upward into the lamp from a reclined or sitting position which is lower than the light source.

I have perceived that there is a need for a bookholder which may be attached to a conventional floor lamp with little effort, without damage to the lamp, and which can be easily removed and folded up into a minimum space when not in use. I have further observed that while bookholders attached to, or adapted for attachment to, pole lamps are known in the prior art, they are poorly suited for a reader who may be in a reclined position or sitting below the light source, since there is a glare in the reader's eyes.

For example, U.S. Pat. No. 438,856 Mueller, issued Oct. 21, 1890; U.S. Pat. No. 1,538,198—Manchester, issued May 19, 1925; and U.S. Pat. No. 1,781,203—Teliki, issued Nov. 11, 1930 all show bookholders or lectern devices adapted to be attached to the standard or pole supporting a light source, but do not protect the reader's eyes from the glare of the light source. While my own patents mentioned above all recognize and solve the problem of shading the eyes of the reader from the glare of the light source, these arrangements are best suited where the distance and orientation of the reading matter from the light source is more or less fixed. However, in the case of a bookholder which is adapted to be attached to any one of a great variety of shapes and sizes of independent light sources, there is a need for an equally adaptable and flexible device to shade the eyes of the reader, regardless of the type of standard supporting the light source. At the same time, the bookholder must be adapted for folding into a compact position and useful in a variety of situations. Ideally, it may also be used as a free-standing, table-top bookholder without attachment to the light source standard.

Accordingly, one object of the present invention is to provide an improved bookholder with an adjustable shade which is adapted for attachment to the standard of a light source.

Another object of the invention is to provide an improved bookholder for holding a book in a selected orientation with respect to an independent light source, having an improved adjustable shade to protect the reader s eyes from the glare of the light source.

SUMMARY OF THE INVENTION

Briefly stated, the invention comprises an improved bookholder for use with a lamp of the type having a light source mounted on a standard, the bookholder comprising a book support having a back rest and ledges adapted to hold the book in a selectable orientation, attachment means connected to the back rest and arranged to be removably connected to the light source standard, an adjustable arm adapted for attachment at one end thereof to the bookholder, the arm being sufficiently flexible to be bent to a desired shape and sufficiently rigid, to maintain the shape after it is bent, and a shade attached to the other end of the adjustable arm, whereby the shade may be adjusted with respect to the light source and a book on the book support.

In a preferred embodiment the shade comprises an single piece of translucent or opaque material. In an alternate embodiment, the shade comprises a plurality of light-attenuating vanes which may be folded up like a fan when not in use, or opened to any desired extent to change the size of the shade. The adjustable arm holding the shade may be bent or moved in a variety of directions to adjust the position of the shade with respect to the light source.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawing, in which:

DESCRIPTION OF THE PREFERRED EMBODIMENT

Figure 1:
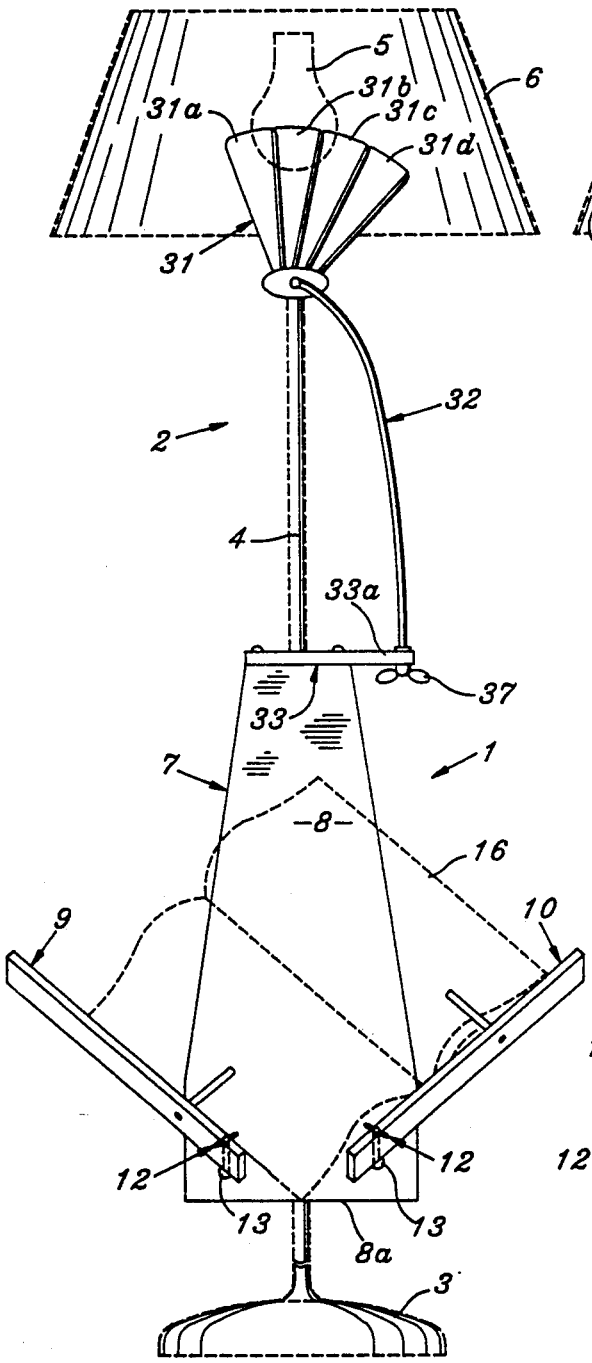
FIG. 1 is a front elevation view of my improved bookholder, with conventional pole lamp and a book on the bookholder shown in phantom lines.
Figure 2:
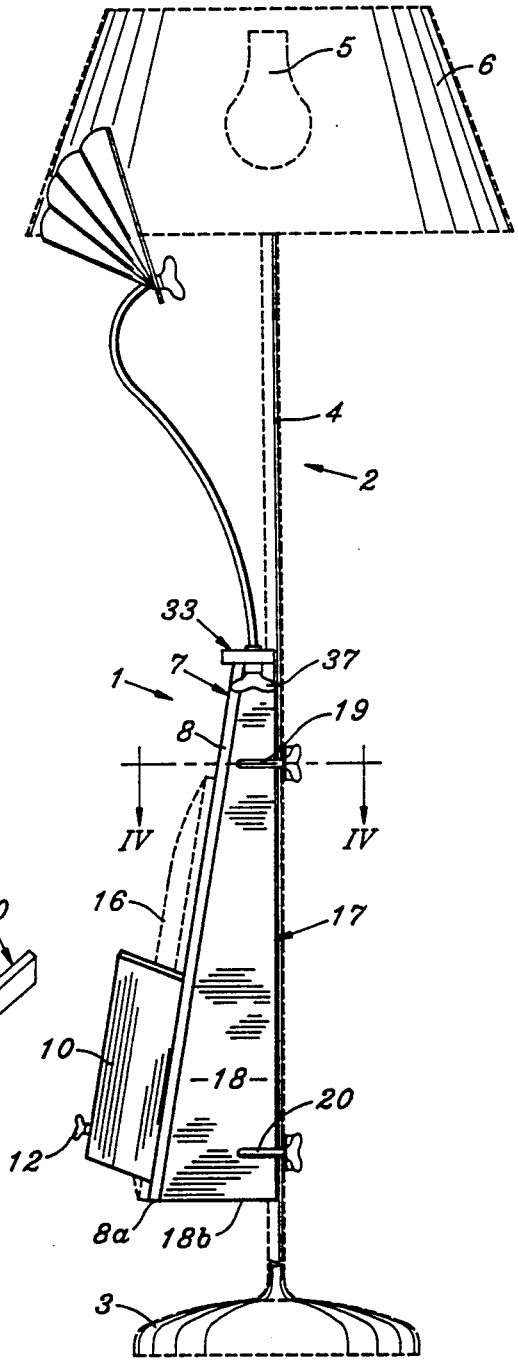
FIG. 2 is a side elevation view of the bookholder of FIG. 1.
Figure 3:
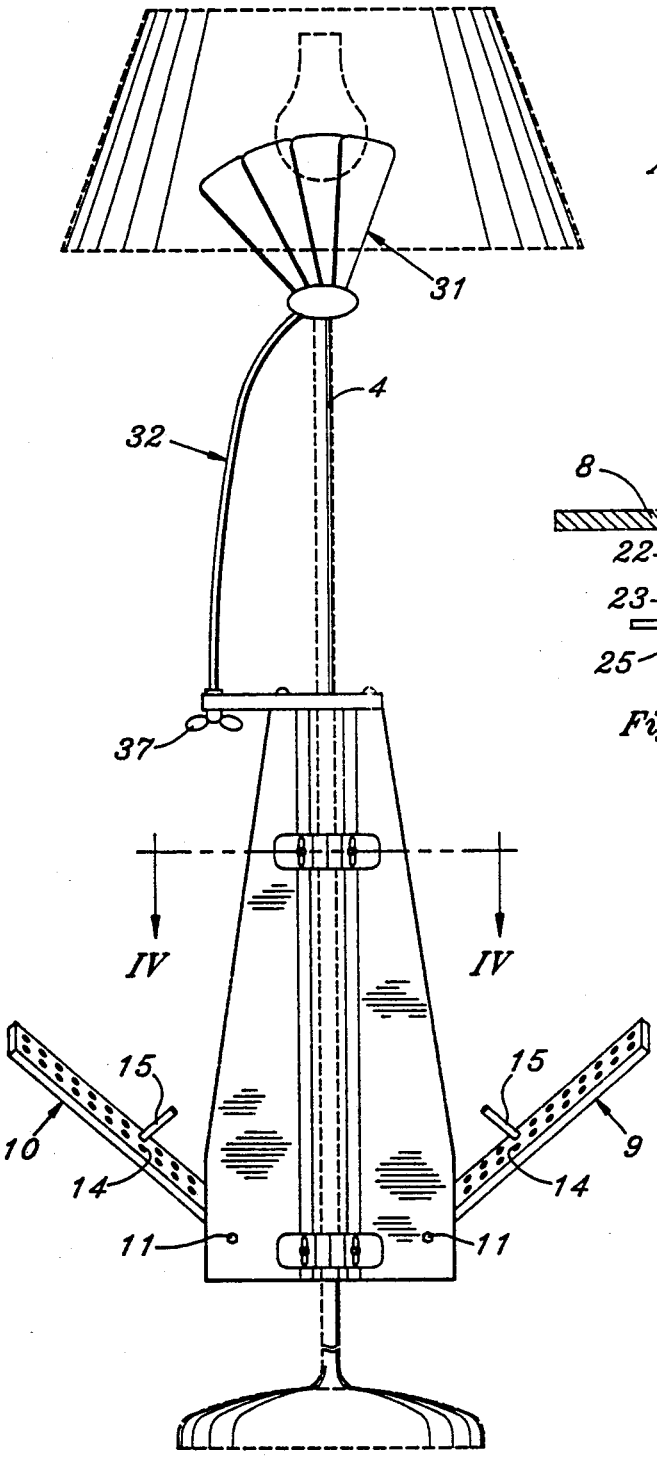
FIG. 3 is a rear elevation view of the bookholder of FIG. 1.

Referring now to FIG. 1, 2 and 3 of the drawing, a bookholder, shown generally as 1 is used with a free standing lamp, shown generally as 2 in phantom lines. The lamp has a standard shown as comprising a base 3 and a vertical support pole 4. The standard carries the wiring and electrical fixtures for a light source 5, with a conventional lamp shade 6. While the standard for light source 5 is illustrated as a pole and base, the standard might also be adapted for clamping to a bed or table and can exist in a variety of shapes and sizes, as well as including the upright member of a tall table lamp. The term standard is defined as including any type of support member or stand, whether standing on the floor or clamped to a piece of furniture or equipment.

Bookholder 1 comprises a book support shown generally at 7, consisting of a back rest 8 and pivotable ledges or shelves 9, 10 pivotally attached to the back rest 8. In a first embodiment, the back rest is an elongated flat member and the ledges are pivotally attached at either side on the bottom end of back rest 8 (as shown in FIGS. 1, 2 and 3). The shelves are pivoted on bolts 11 (FIG. 3) passing through the back rest and the respective Pivotable arms 9, 10 and secured by wing nuts 12. Washers 13 are inserted between the back rest 8 and ledges 9, 10 to provide a bearing surface so that the back rest will not be scratched when the ledges are pivoted so that the reader may orient the book 16 for comfortable viewing.

Figure 6:
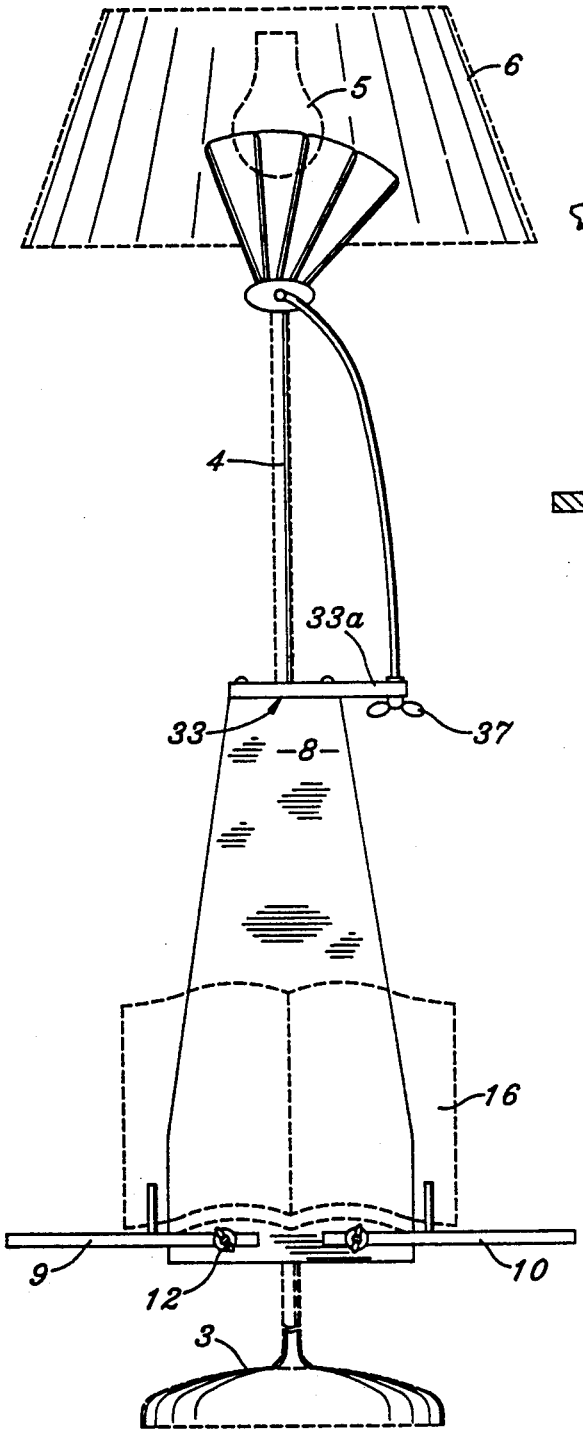
FIG. 6 is a front elevational view similar to FIG. 1 with the book held in a different orientation.
Figure 8:
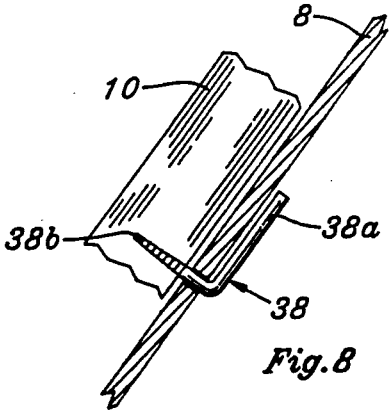
FIG. 8 is a cross-sectional side elevation view illustrating a preferred type of attachment means for attaching the ledges to the bookholder back rest 8.
Figure 12:
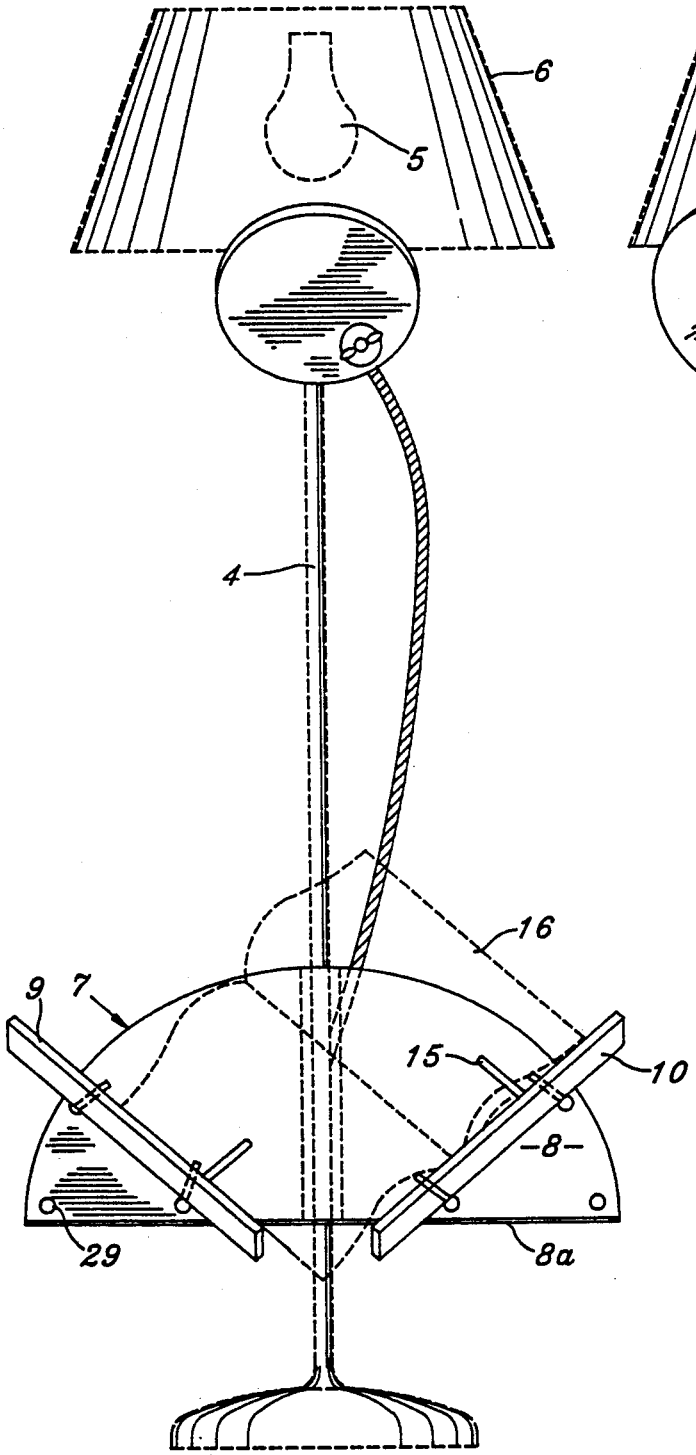
FIG. 12 is a front elevational view of an alternate embodiment of my improved bookholder, with conventional pole lamp and a book on the bookholder shown in phantom lines.

Reference to FIG. 8 and 12 show an alternate method for attaching the ledges 9 and 10 to the back rest 8. In said alternate method, each ledge 9 or 10 is attached to one side on the bottom end of back rest 8 by right angle hooks 38. One end 38*a* of said right angle hook 38 lies parallel to the plane created by back rest 8 and the other end 38*b* serves to anchor the ledges 9, 10 to the back rest 8 and is perpendicular to the plane created by said back rest 8. In this second embodiment, book orientation holes 39 (shown somewhat enlarged for clarity in FIG. 12) are provided in the back rest 8 and ledges 9, 10 are attached into said book orientation holes 39 by said right angle hooks 38. The ledges 9, 10 may then be adjusted so that the book 16 may be alternately positioned parallel to the bottom edge 8*a* of the back rest 8 (such as shown in FIG. 6) or at a 45° angle from the plane created by said bottom edge 8*a* (FIG. 12).

Ledges 9, 10 are fitted with adjustment holes 14 and pegs 15, so that a book 16 (shown in phantom lines) may be held at a desired orientation against back rest 8.

A variety of other types of attachments for arms 9, 10 and a variety of other types of holding means for the book pages, are seen in my aforesaid U.S. Pat. Nos. 4,998,703; 4,896,252; and 4,907,777 which are incorporated herein by reference.

The book support 7 is arranged to be removably attached to the lamp standard by attachment means shown generally at 17 comprises a shaped support member 18 and a pair of attachment clamps 19, 20. As best seen in FIG. 3, the support member 18 has a groove 18*a* along its length to accommodate the pole 4, while the clamps 19, 20 clamp the pole 14 in groove 18*a*. The bottom edge 18*b* of the support is coplanar with the bottom edge 8*a* of the back rest, so that the bookholder can be self supporting as a free-standing unit. Therefore, the support holds the back rest at an inclined position, both when clamped to pole 4 and when used as a free-standing bookholder without a lamp standard. A number of types of support members are suitable for supporting the book support with back rest 8 in an inclined position, and a variety of clamps are suitable for removably attaching the book support to the lamp standard holding the light source. Also, a variety of forms of the back rest and the support may be adapted to alternatively support the bookholder as a free-standing unit.

Figure 4:
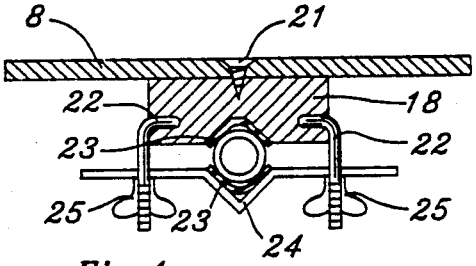
FIG. 4 is an enlarged cross section plan view looking in the direction of arrows IV—IV FIGS. 2 and 3.

Reference to FIG. 4 shows one preferred embodiment, wherein the back rest 8 is shown connected to a wooden support member 18 by means of a wood screw 21. Plastic parts may be substituted for the wooden parts shown. A pair of clamping bolts 22 are bent and anchored in the support member 18 with epoxy glue. Soft rubber or similar material is used for pads 23 around pole 4, and clamped around the pole by a clamping plate 24 and wing nuts 25.

Figure 10:
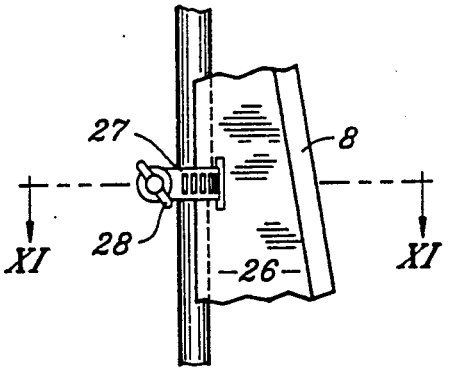
FIG. 10 is a partial side elevation view of a modified type of attachment means to a lamp standard.
Figure 11:
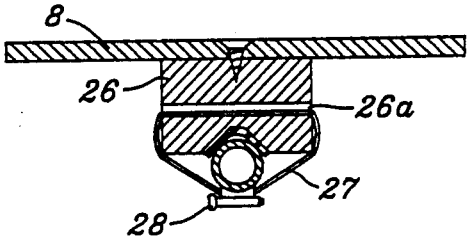
FIG. 11 is a cross sectional, plan view of the attachment of the FIG. 10; taken along lines XI—XI.

A modification of the attachment clamps may be seen in FIGS. 10 and 11. In this case, a modified support member 26 includes slots 26*a* adapted to receive a worm drive type clamp, similar to an automotive hose clamp. As shown in FIGS. 10 and 11, a slotted metal strip 27 is threaded through slot 26*a* and tightened with a worm drive bolt and wing nut of a type known in the art.

The book support 7 and the attachment means 17, together make up the bookholder. The bookholder is fitted with an adjustable shade, comprising shade 31 and an adjustable arm 32. In a preferred embodiment, the adjustable arm 32 is adapted so that it may be attached at one end to a shade 31 and at the other end inserted into a hole in the support member 18 where it may be secured with adhesive. In an alternate embodiment, adjustable arm 32 is adapted for attachment at one end thereof to a bracket on the bookholder, and at the other end thereof to shade 31, so as to support the shade 31 from the bookholder.

In said alternate embodiment, a shade support bracket is provided by a metal plate 33. Metal plate 33 is attached to the top of the book rest 8 by screws and includes a lateral extension 33*a*, with a hole into which is inserted the threaded end of adjustable arm 32. The adjustable arm may alternatively be attached to any convenient part of the book support, in this case the back rest 8, or it could equally well be attached to a similar bracket on part of ,the attachment means,, such as the support member 18. In either embodiment, the adjustable arm is selected and constructed so as to be sufficiently flexible to be bent to a desired shape and sufficiently rigid to maintain the shape after it is bent, so as to support and hold the position of the shade 31.

Figure 7:
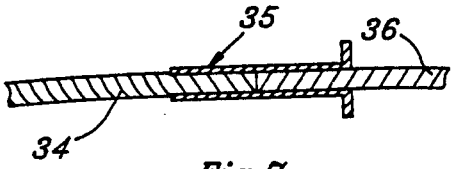
FIG. 7 is an enlarged elevation view in section showing a preferred embodiment of the adjustable arm at the bookholder end.

Referring to FIG. 7, the adjustable arm is shown in a preferred embodiment as constructed from a flexible spiral metal hose 34 of the type similar to one used in a "goose neck" lamp, and is secured by soldering or welding inside a sleeve 35 to a terminating threaded bolt 36. The threaded bolt 36 may be inserted through the plate extension 33 and clamped thereto by a wing nut 37 (see FIGS. 1-3).

Figure 9:
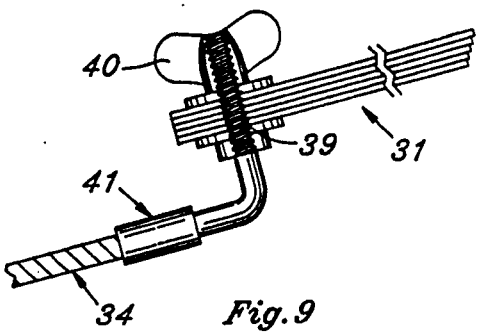
FIG. 9 is an enlarged view, partly in section, illustrating the attachment of the shade to the adjustable arm.
Figure 13:
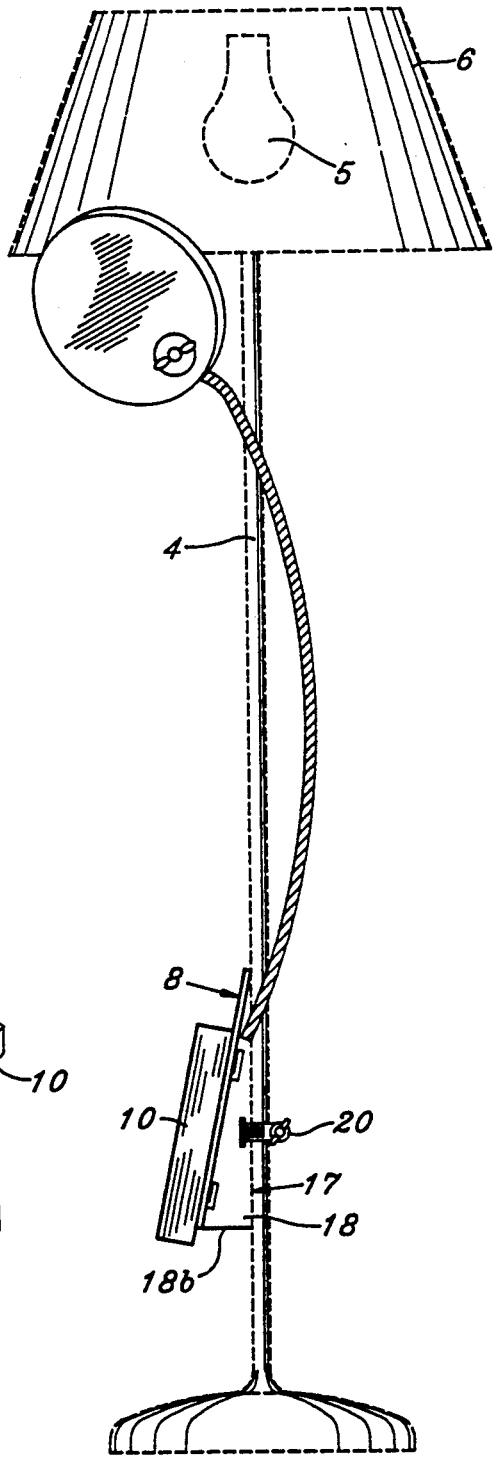
FIG. 13 is a side elevational view of the bookholder of FIG. 12.

A preferred shade 31 (FIGS. 12, 13) comprises a single circular piece made of opaque or translucent material. An alternate embodiment of shade 31 (FIG. 1) comprises a plural of vanes 31*a*, 31*b*, 31*c*, 31*d* which may be metal or plastic plates. Reference to FIG. 9 of the drawing illustrates that the other end of spiral metal hose 34 is attached by a sleeve 41 with epoxy to a threaded extension 39. The vanes are clamped between suitable washer plates by wing nut 40. By this expedient, vanes 31*a*-31*d* may be spread like a fan to the desired size, and the flexible arm 32 may be bent to the proper position, whereby the size and position of the shade may be adjusted with respect to the light source 5 and the book 16. Vanes 31*a*-31*d* can be of any suitable number and may either be opaque or translucent to attenuate the glare from light source 5. For some applications, only one vane or plate is necessary.

Figure 5:
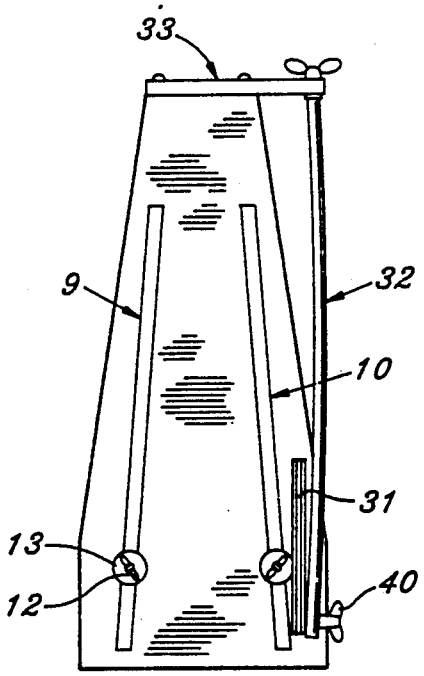
FIG. 5 is a front elevational view of the bookholder with shade and ledges arranged for storage.

The bookholder may be folded up for storage referring to FIG. 5, the bookholder with shade support bracket is shown folded up for storage. Wing nut 37 is removed, arm 32 is reversed in the hole in extension 33*a*, and vanes 31 are folded up and secured by the wing nut 40 adjacent the back rest 8. Pivotable arms 9, 10 are folded and clamped in position to provide a compact bookholder for storage.

Reference to FIG. 6 shows the pivotable arms 9, 10 in a horizontal position for supporting the book 16 in a different orientation, similar to a lectern, for reading from a sitting position. Flexible arm 32 and shade 31 may be readjusted and arranged for a new size and position of the shade.

While there has been described herein what is considered to be the preferred embodiment of the invention, other modifications will occur to those skilled in the art. It is desired to secure, in the appended claims, all such modifications as fall within the true spirit and scope of the invention.

What I claim as new and desire to secure by Letters Patent of the United States is:

1. An improved bookholder for use with a lamp of the type having a standard and a light source mounted on said standard, said bookholder comprising:

a hook support having a back rest and a plurality of ledges adapted to hold a book at a selected orientation for a reader;

attachment means connected to said book support adapted to be removably attached to said standard and arranged to hold said book support for illumination under said light source;

an adjustable arm adapted for attachment at one end thereof to aid bookholder, said arm being sufficiently flexible to be bent to a desired shape and sufficiently rigid to maintain said shape after it has been bent; and a shade attachment to the other end of said adjustable arm, whereby said shade may be adjusted with respect to the light source and book on the bookholder to block glare from the light source to the eyes of said reader.

2. The combination according to claim 1, wherein said shade has a plurality of light attenuating vanes mounted for movement relative to one another for adjusting the size of the shade.

3. The combination according to claim 1, wherein said back rest comprises an elongated flat member having ledges mounted on one end and on either side thereof, whereby they may be folded together along the back rest, and a shade support bracket mounted on the opposite end of the back rest adapted to hold the end of the adjustable arm and to permit holding the arm and shade along the back rest for storage, said shade support bracket being for storage.

4. The combination according to claim 1, wherein said attachment means comprises a support member connected to the back rest and adapted for connection to said standard, so as to hold the back rest in an inclined position.

5. The combination according to claim 4, wherein said support member defines a groove, and wherein said attachment means further includes a pair of clamps connected to support member and arranged to clamp portions of the standard into said groove.

6. The combination according to claim 4, wherein said support member and said back rest both define portions adapted to alternatively support said bookholder as a free-standing unit.

7. The combination according to claim 1, wherein said adjustable arm comprises a flexible spiral metal hose.

8. The combination according to claim 1, wherein said adjustable arm comprises a flexible spiral metal hose and wherein said shade comprises a plurality of light attenuating vanes mounted on said adjustable arm for movement relative to one another.

9. The combination according to claim 1, wherein said plurality of ledges are adapted so as to be pivotable about said book support.

10. The combination according to claim 1, wherein said plurality of ledges are attached to said book support by right angle hooks.

11. The combination according to claim 1, wherein said shade comprises a single piece of translucent or opaque material.

12. The combination according to claim 4 wherein said support member defines a hole for receiving and holding said one end of said adjustable arm.

* * * * *